US006268401B1

(12) United States Patent
Cook et al.

(10) Patent No.: US 6,268,401 B1
(45) Date of Patent: Jul. 31, 2001

(54) FISCHER-TROPSCH WAX AND CRUDE OIL MIXTURES HAVING A HIGH WAX CONTENT

(75) Inventors: Bruce R. Cook, Stewartsville; Eric B. Sirota, Flemington, both of NJ (US); Hu Gang, Shatin (HK); Loren L. Ansell, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/556,738

(22) Filed: Apr. 21, 2000

(51) Int. Cl.[7] ..... C07C 27/00; C10G 73/00; C10G 73/32; C10L 1/16

(52) U.S. Cl. ..... 518/700; 208/24; 208/37; 585/9

(58) Field of Search ..... 518/728; 208/24, 208/37; 585/9

(56) References Cited

U.S. PATENT DOCUMENTS

Re. 30,281 * 5/1980 Tackett et al. ..... 208/93

* cited by examiner

*Primary Examiner*—Johann Richter
*Assistant Examiner*—J. Parsa
(74) *Attorney, Agent, or Firm*—Jay Simon

(57) ABSTRACT

The invention is a process for producing a mixture of wax and crude oil which can be pumped at ambient temperature. The wax is preferably a Fisher-Tropsch wax. The temperature of the crude oil is controlled to a level below the dissolution temperature of the wax. The wax crystals are homogenized and dispersed into the crude oil to form a mixture. The present invention prevents the wax from dissolving in the crude oil and subsequently re-crystallizing at lower temperatures which can substantially increase the viscosity of the mixture thereby decreasing the effectiveness of transporting the mixture.

6 Claims, 3 Drawing Sheets

FISCHER-TROPSCH WAX AND CRUDE OIL MIXTURES HAVING A HIGH WAX CONTENT

FIELD OF THE INVENTION

The present invention pertains to the transport of products from remote oil production sites with increased economic efficiency.

BACKGROUND INFORMATION

Oil fields typically have deposits of natural gas associated with them. In remote locations where transport of this gas may not be economically attractive, it has been common practice to burn it or re-inject it into the oil field. A relatively new alternative to burning and re-injection is gas conversion technology which offers the opportunity for chemically converting natural gas to higher molecular weight hydrocarbons. Current gas conversion technologies rely on the chemical conversion of natural gas to synthesis gas, a mixture of carbon monoxide and hydrogen, via partial oxidation or steam reforming. Synthesis gas is then reacted in a catalyzed hydrocarbon synthesis process commonly known as Fischer-Tropsch synthesis to form higher molecular weight hydrocarbons.

The preferred method of Fischer-Tropsch synthesis is carried out in a slurry bubble column reactor. This reactor is ideally suited for highly exothermic, three phase catalytic reactions and is described in U.S. Pat. No. 5,348,982. In such reactors, the solid phase catalyst, preferably cobalt, is dispersed or held in suspension in a liquid phase by a gas phase which continually bubbles through the liquid phase, thereby creating a three-phase mixture.

The main products from the Fischer-Tropsch process through the hydrogenation of carbon monoxide are Fischer-Tropsch waxes, which have many desirable properties. More specifically, they have very high purity being essentially free of any sulfur, nitrogen and aromatic species and have high normal paraffin content. Another desirable property of Fischer-Tropsch waxes is their opacity, i.e., their lack of translucent appearance. An additional very desirable property is that Fischer-Tropsch waxes are harder than conventional petroleum waxes. Fischer-Tropsch waxes produced through hydrogenation of carbon monoxide over cobalt catalysts yield harder Fischer-Tropsch waxes.

However, Fischer-Tropsch waxes produced at remote sites are difficult to transport to a location where they can be utilized or sold. Since these waxes are solids, they cannot be transported via conventional shipping or pipeline. Therefore, Fischer-Tropsch waxes are typically converted by reacting the Fischer-Tropsch wax with hydrogen over a hydroisomerization catalyst (U.S. Pat. No. 5,882,505) to form a liquid that can be pumped and hence, economically transported. This conversion represents a significant financial investment in gas conversion technologies. To reduce this investment, it is advantageous to combine raw Fischer-Tropsch wax product and crude oil to obtain a mixture that can be pumped and hence, economically transported from a remote site.

Wax and crude oil mixtures are typically produced by heating streams of wax and crude oil to a temperature above the melting point of the wax and subsequently mixing the two liquids together. However, during transport by pipeline such mixtures will cool resulting in the formation of crystallized networks of wax which will substantially increase the viscosity of the mixture. In addition, solid wax will form deposits along the walls of the pipeline in which crude oil is being transported, thereby decreasing the effectiveness of the pipeline and potentially causing damage to the pipeline structure. These consequences severely limit the amount of wax that can be blended into the crude oil. It is clearly desirable to increase the amount of wax that can be dispersed in crude oil since higher wax levels increase the overall volume of the blend that can be transported without significantly increasing the viscosity at lower temperatures. This objective is substantially achieved by the present invention.

SUMMARY OF THE INVENTION

In accordance with the present invention, wax, preferably Fischer-Tropsch wax, is blended with crude oil to form a mixture with high wax content that can be pumped at ambient temperature. If necessary, the crude oil is initially cooled to temperatures below the dissolution temperature of the wax. Fischer-Tropsch wax crystals are then dispersed and homogenized into the crude oil resulting in a product that can be pumped at ambient 1 temperature. Fischer-Tropsch waxes are preferred because they are hard waxes which decrease the likelihood of wax dissolving in the crude oil and later re-crystallizing which would increase the viscosity and form deposits on the pipeline walls.

BRIEF DESCRIPTION OF THE DRAWINGS

FIG. 3(*b*) is a graph of viscosity versus shear stress for 10% AGC-21 Fischer-Tropsch wax at room temperature in ANS crude oil.

DETAILED DESCRIPTION OF THE INVENTION

The present invention provides a flow scheme which is capable of producing mixtures of crude oil containing from about 1 to 30% wt/wt wax, most preferably containing from about 10–20% wt/wt wax, that can be pumped. This process involves sequentially cooling the crude oil to below the dissolution temperature of the wax, preferably at least 20° C. below this dissolution temperature, and most preferably cooled to a range between 10° C. and 40° C. above the pour point of the crude oil only. The crude oil is then homogenized and solid crystals of finely particulate wax, most preferably Fischer-Tropsch wax, are dispersed into the crude oil. Subsequent control of the temperature prevents heating of the wax and crude oil mixture to a temperature that would cause the wax to dissolve, e.g. above about 120° C. The dissolution temperature for purposes of the present invention is defined as that temperature where the wax and crude oil mixture would become a liquid phase with no discernable wax crystals remaining. This temperature will vary depending on the crude oil as well as the characteristics and weight fraction of the wax mixed. One particularly important characteristic would be the hardness of the wax. Those skilled in the art know that this temperature can be readily determined for a given wax and oil mixture.

In the mixture, smaller wax crystals are preferable, with a desired range from about 1–10 microns. Smaller crystals have less tendency to settle out of the mixture.

Figure 1:
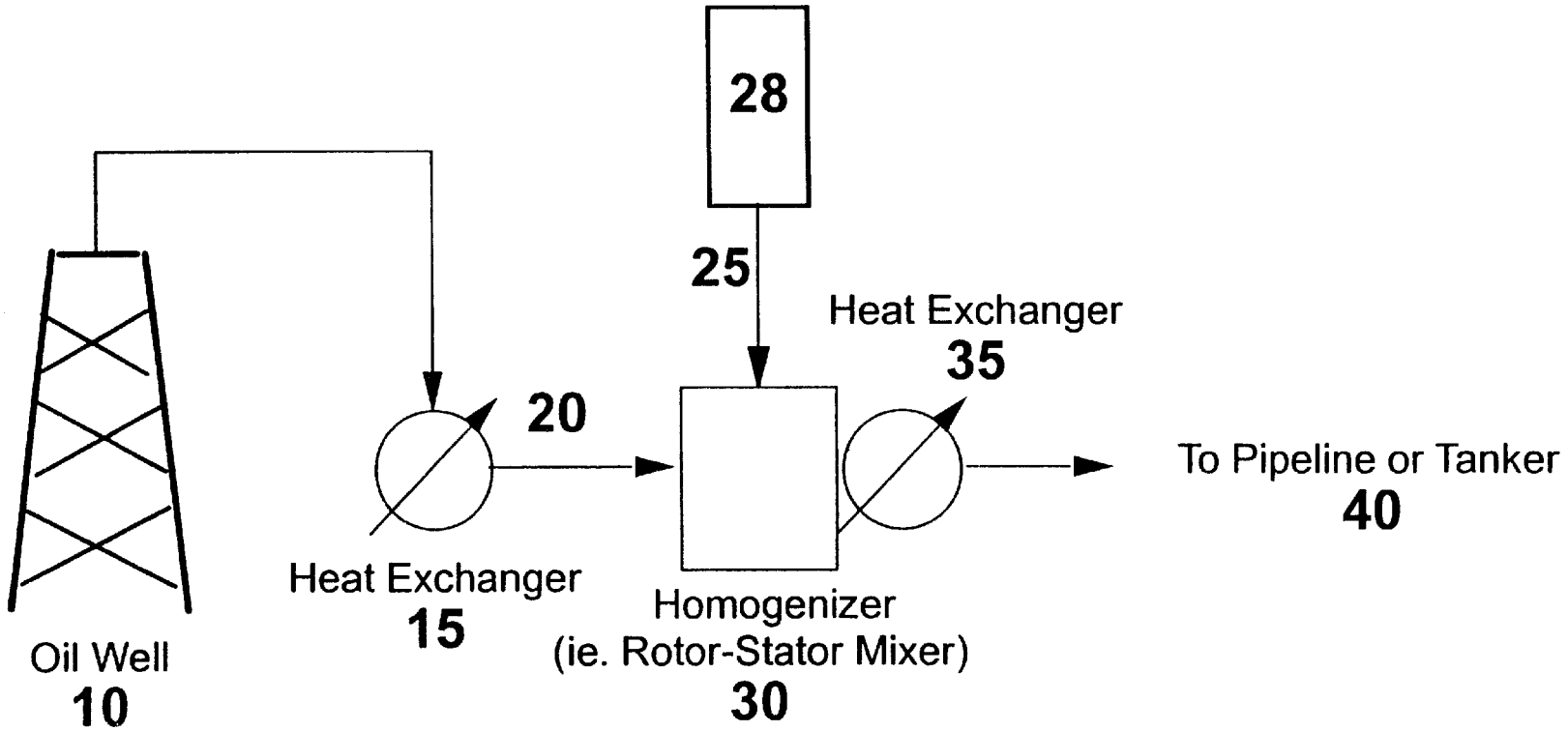
FIG. 1 is a process flow scheme for producing Fischer-Tropsch wax and crude oil mixtures that can be pumped.

As illustrated in FIG. 1, crude oil is pumped from the oil well 10 directly to a first heat exchanging means 15, which reduces the temperature of the crude oil to below the dissolution temperature of the wax to be blended therewith. The crude oil is cooled to at least about 20° C. below the dissolution temperature of the wax, and most preferably to not more than about 10° C. above ambient temperature. However, in the event that the crude oil does not require cooling, then the temperature of the crude oil will be controlled according to the above-mentioned temperatures.

From the first heat exchanging means 15, the crude oil flows through a pipeline 20 to a homogenizer 30 such as a rotor-stator mixer. The wax crystals are created via a Fischer-Tropsch reactor and wax crystallization device 28 commonly known in the art. The wax crystals are introduced to the homogenizer 30 via a pipeline source 25 and homogenized and dispersed in the crude oil. The temperature of the homogenization process is regulated using second heat exchanging means 35 of a type well known in the art to prevent heating of the wax and crude oil mixture above a pre-determined temperature as stated above.

The temperature-regulated mixing technique produces a wax and crude oil mixture with a very high wax content that can be pumped at ambient temperatures via a pipeline or to a tanker 40. The present invention prevents the formation of wax crystal networks that would ordinarily occur when dissolved wax crystallizes from the crude oil at ambient temperatures. This is advantageous because the mixture can be pumped and there is a marked decrease in wax deposition on the pipeline walls. A further benefit of the present invention is that the higher wax content in the mixture formed permits a substantially increased volume of wax to be transported via existing equipment such as pipelines.

EXAMPLE 1

A series of dispersed Fischer-Tropsch wax (F-T Wax) in Alaska North Slope (ANS) crude oil mixtures were made at 3.8, 7.4, 13.8, and 19.4 wt %. The Fisher-Tropsch wax is a fraction that nominally boils above 285° C. and was prepared by reacting 2:1 H2: CO syngas over a supported cobalt catalyst in a slurry bubble column reactor. Conditions of the Fischer-Tropsch reactor were 222–236° C.; 265–290 psig, and 4800–7200 gas hourly space velocity (GHSV). The samples were prepared by mixing 4, 8, 16, and 24 grams of Fischer-Tropsch wax with 100 grams of ANS crude oil in a Laboratory Waring Blender for two minutes at the maximum setting. This level of mixing was adequate to completely disperse 24 grams of Fischer-Tropsch wax in 100 grams of Isopar M. The temperature of the samples increased to 38° C. as a result of mixing. All samples appeared to be stable dispersions with no noticeable separation over a period of weeks. As shown in Table 1, all of the four Fischer-Tropsch wax and ANS crude oil mixtures could be poured at room temperature which means they can be pumped at room temperature and above. The pour point test is ASTM standard test D97.

TABLE 1

Pour points of Alaska North Slope Crude Oil

| Sample | Pour Point (° C.) |
|---|---|
| Alaska North Slope Crude Oil | −16 |
| 3.8 wt % F-T Wax in ANS | −16 |

TABLE 1-continued

Pour points of Alaska North Slope Crude Oil

| Sample | Pour Point (° C.) |
|---|---|
| 7.4 wt % F-T Wax in ANS | −2 |
| 13.8 wt % F-T Wax in ANS | +7 |
| 19.4 wt % F-T Wax in ANS | +14 |

Figure 2:
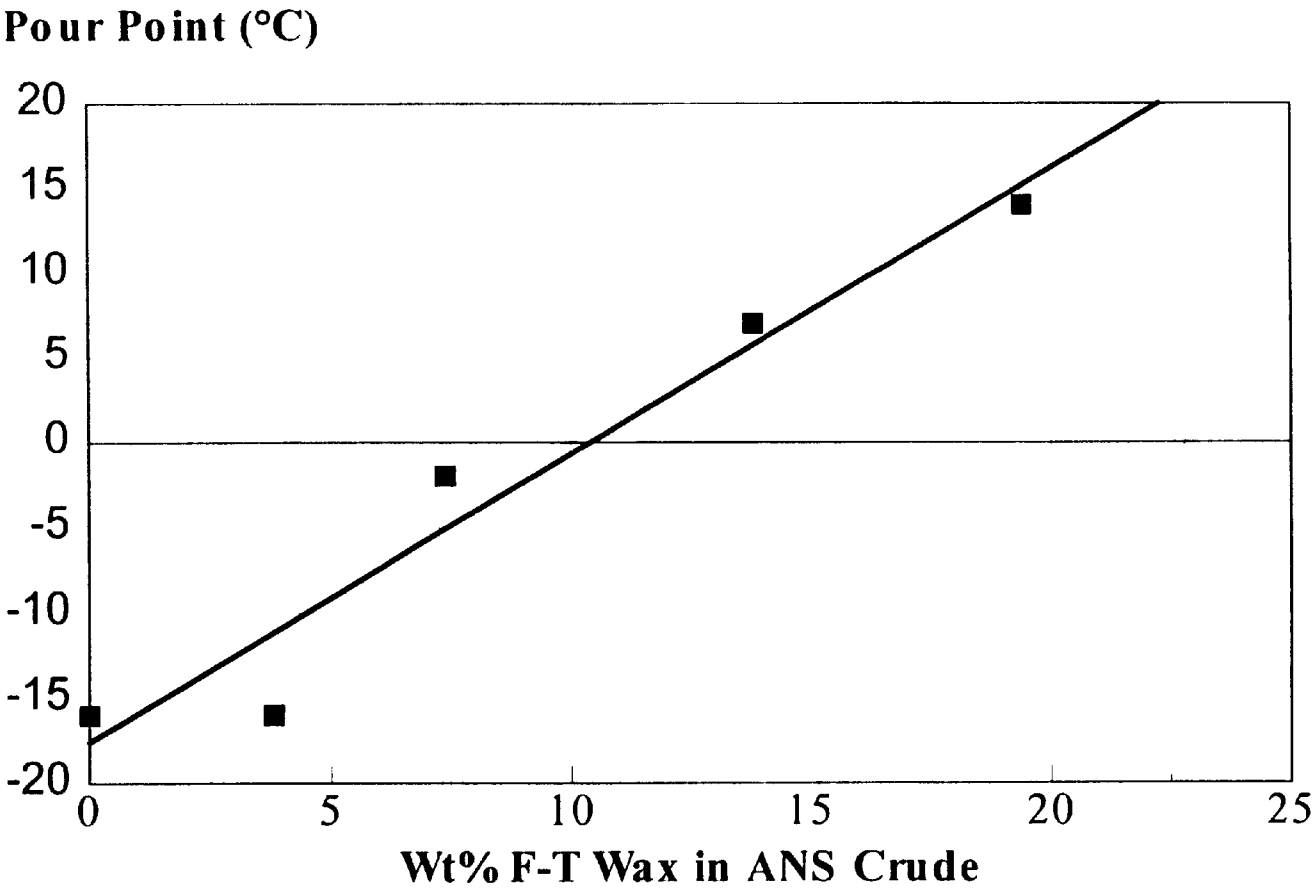
FIG. 2 is a graph of pour point versus weight percentage of AGC-21 Fischer-Tropsch wax at 25° C. in ANS crude oil.

In FIG. 2, the pour points of the mixture are plotted vs. the wt % of AGC-21 in the fraction, which based on a first approximation follows linear behavior up to 20 wt % wax. The pour point for a blend of 20% Fischer-Tropsch wax in ANS crude oil is approximately 15° C.

EXAMPLE 2

Figure 3A:
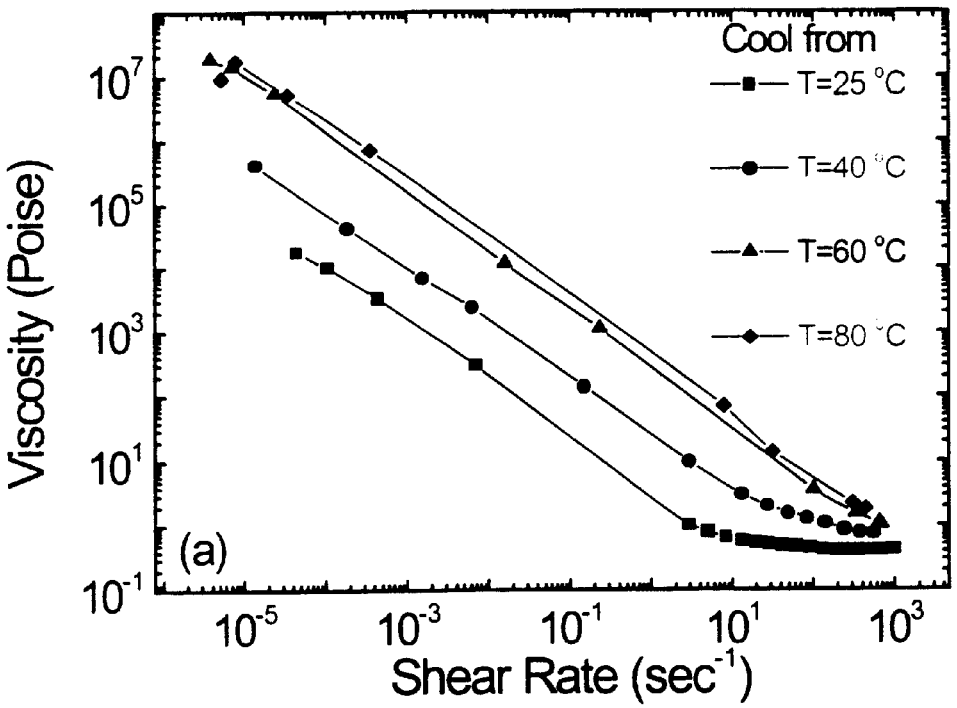
FIG. 3(*a*) is a graph of viscosity versus shear rate for 10% AGC-21 Fischer-Tropsch wax at 25° C. in ANS crude oil.
Figure 3B:
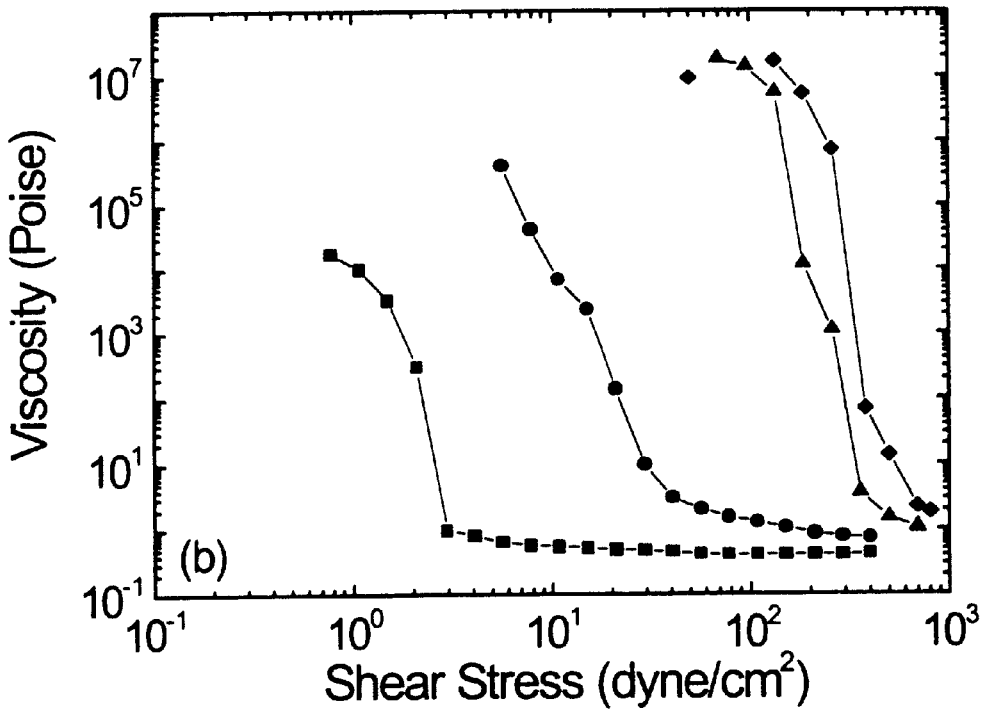

The increase in low temperature viscosity from heating is shown in FIGS. 3*a* and 3*b*. A 10 wt % Fischer-Tropsch wax in an ANS crude oil blend was subjected to various temperatures and cooled to 25° C. The measurements were made at 25° C. after the sample went through a heating and cooling cycle. Data are plotted as viscosity versus shear rate and viscosity versus shear stress. The latter clearly shows a different yield stress when cooling down from a different temperature. The viscosity versus shear relationship was measured after each thermal treatment. Those samples treated at higher temperature showed consistently higher viscosities and also required higher shear to break the wax crystal network.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the apparatus may be varied substantially without departing from the spirit of the invention and the exclusive use of all modifications which come within the scope of the appended claims is reserved.

What is claimed is:

1. A process of forming a mixture of wax and crude oil which can be pumped at ambient temperature comprising:

(a) controlling the crude oil to a temperature below the dissolution temperature of said wax; and (b) homogenizing and dispersing wax crystals into said crude oil to form a mixture.

2. A process according to claim 1, wherein said wax is a Fischer-Tropsch wax.

3. A process according to claim 1, wherein said crude oil is cooled to at least about 20° C. below the dissolution temperature of said wax.

4. A process according to claim 1, wherein said crude oil is cooled to a temperature of about 10° C. to 40° C. above the pour point of said crude oil.

5. A process according to claim 1, wherein said wax crystals are within the range of 1 to 10 microns.

6. A process according to claim 1, wherein said mixture contains about 1 to 30 percent wt/wt wax.

* * * * *